US008607932B2

(12) United States Patent
Cooper et al.

(10) Patent No.: US 8,607,932 B2
(45) Date of Patent: Dec. 17, 2013

(54) LADDER STABILIZING ATTACHMENTS

(76) Inventors: William Albert Cooper, Melbourne (AU); Rosemary Jennings Cooper, Melbourne (AU)

( * ) Notice: Subject to any disclaimer, the term of this patent is extended or adjusted under 35 U.S.C. 154(b) by 1095 days.

(21) Appl. No.: 11/807,812

(22) Filed: May 31, 2007

(65) Prior Publication Data

US 2008/0029341 A1 Feb. 7, 2008

(51) Int. Cl.
*E06C 1/22* (2006.01)
*E06C 7/46* (2006.01)

(52) U.S. Cl.
USPC ..... 182/172; 182/109; 182/111

(58) Field of Classification Search
USPC ..... 182/172, 108, 109, 111
See application file for complete search history.

(56) References Cited

U.S. PATENT DOCUMENTS

| | | | | | |
|---|---|---|---|---|---|
| 1,890,423 | A * | 12/1932 | Teagarden | ..... | 42/94 |
| 4,565,262 | A * | 1/1986 | Hawkins | ..... | 182/116 |
| 4,872,529 | A * | 10/1989 | Viets | ..... | 182/172 |
| 2004/0231921 | A1* | 11/2004 | Ramirez | ..... | 182/172 |
| 2005/0194213 | A1* | 9/2005 | Beczak | ..... | 182/129 |

* cited by examiner

*Primary Examiner* — Alvin Chin Shue

(57) ABSTRACT

A ladder stabilizing attachment for a ladder is disclosed. The device is basically made of two or more long variable length stabilizing legs FIGS. (1) and (11) attached to the upper part of a ladder by universal joints FIGS. (9) and (9A), and capable of forming a triangular or multi-angular pyramid with the ladder. The legs can be independently positioned to give greater lateral stability, as well reducing slide out tendency of the ladder base. The foot sockets of the stabilizing legs FIG. (5) are designed to minimize overloading and movement due to ladder flexing. The device is constructed so that it can be built into new ladders, and readily adapted for and fitted to most existing ladders.

2 Claims, 9 Drawing Sheets

Alternate Universal Joint Design

Alternate attachment of Support Bar

LADDER STABILIZING ATTACHMENTS

The current design of ladders presents a number of potential hazards to the users, mainly from overbalancing, and the slide out movement of the ladder to the side or away from its vertical support. Also tilting caused by rotation about its upper support (such as a pole or a tree) and the recommended angle of 75 degrees to the horizontal, (or 4 to 1), for ladder placement, designed to minimize the chance of slipping, can create a further hazard.

BACKGROUND OF THE INVENTION

This invention is designed to give stability to the whole ladder, help to prevent sideways or backward movement, slippage of the base and reduce tilting or rotation due to unsatisfactory support. It will also allow a smaller angle of placement, with accompanying improvement in the users safety It is designed so that it can be built into new ladders as well as being easily fitted and adapted to existing ladders. It can be a permanent attachment, and/or fitted as a separate detachable unit (with or without a permanently attached unit) if special features for special purposes are required It is simplistically designed for quick and easy use, light in weight and unobtrusive in ladder stacks. (FIG. 2)

SUMMARY OF THE INVENTION

The ladder stabilizing invention basically is made up of two or more long stabilizing legs attached to the upper part of a ladder by universal joints and capable of forming a triangular or multi angular pyramid with the ladder. The universal joints allow the stabilizing legs (SLs) to be positioned laterally when the ladder is in situ against a wall, thereby reducing the possibility of lateral movement of the ladder from side to side, and when placed at an angle from the vertical and towards the ladder, the tendency for the base of the ladder to slip outwards from the wall.

The SLs are designed to stabilize rather than take the full weight from the ladder, and so are fitted with a spring loaded foot socket designed to absorb overloading due to ladder flexing and sagging and to prevent SL movement due to irregular movements of the operator.

For simplicity the special case when only two Sls are fitted will be described but the design, the principles and the functioning applies to the fitting of any number of SLs.

It is recognized that ladders can be used on many different surfaces, soft and hard, rough and smooth, and the basic structural principal can be varied to minimize presenting hazards. On soft ground a base plate can be used below the foot socket. FIG. (7). On smooth or low friction surfaces rigid strip ties FIG. (3) can be fitted to the SLs and ladder to reduce the possibility of outward slip, and/or the universal joints can be rigidly clamped.

With the two SLs angled away from the wall in the direction of the ladder base the potential outward slip of the ladder is reduced, and the 75 degree angle of the ladder to the ground can be reduced with increased convenience and safety.

DETAILED DESCRIPTION OF THE INVENTION

Figure 1:
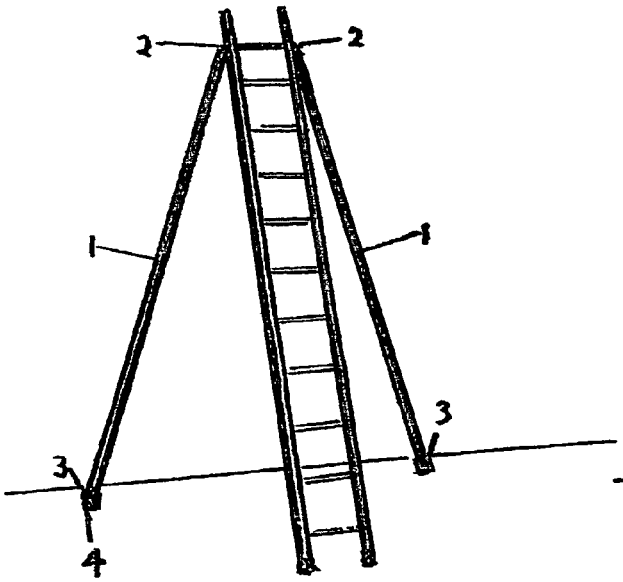
FIG. 1 illustrates the stabilizer legs connected to the ladder.
Figure 2:
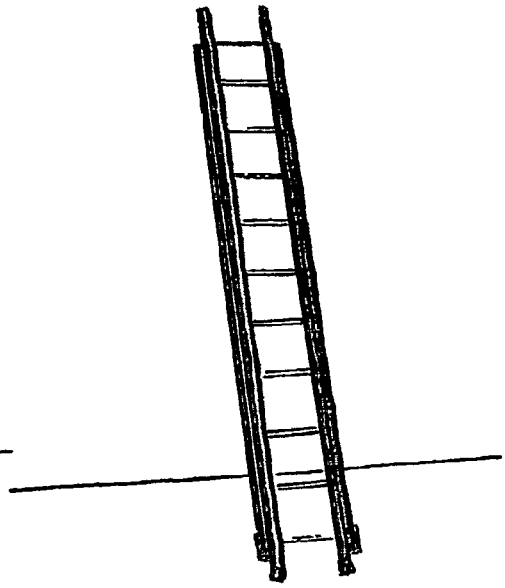
FIG. 2 illustrates the stabilizer legs folded along the ladder.
Figure 3:
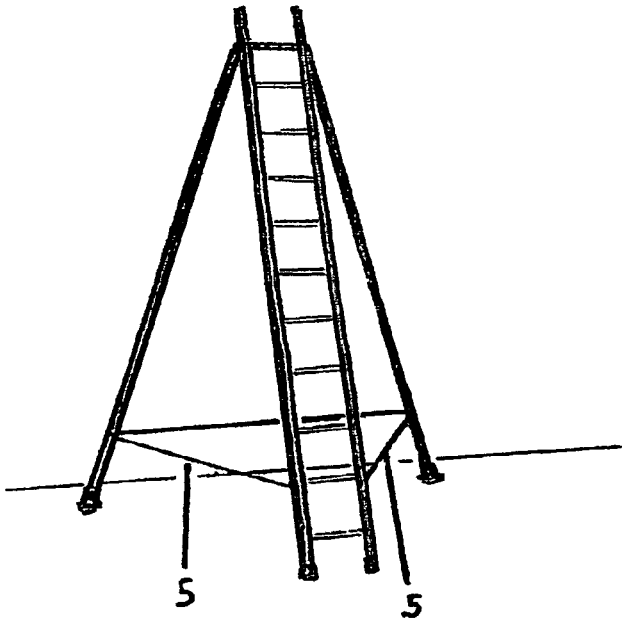
FIG. 3 illustrates the stabilizer legs with rigid hinged ties.
Figure 4:
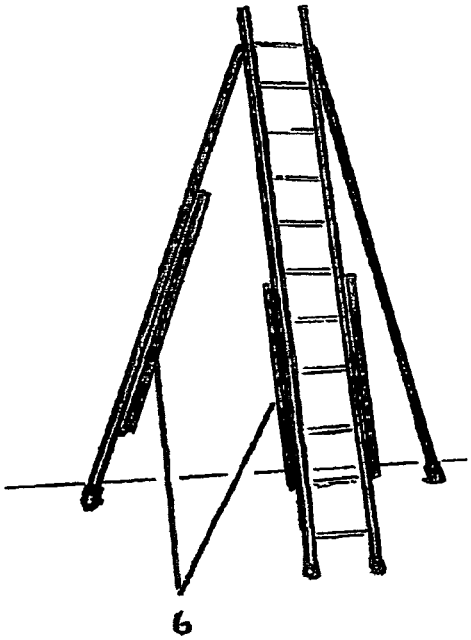
FIG. 4 illustrates the stabilizer legs with the ties folded away.
Figure 5:
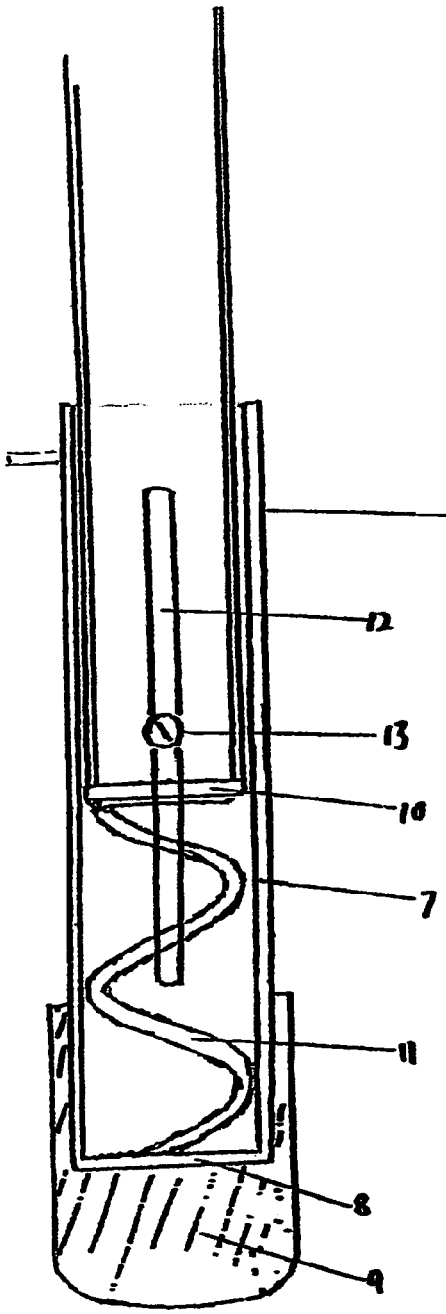
FIG. 5 illustrates the stabilizer leg with spring loaded foot socket.
Figure 6:
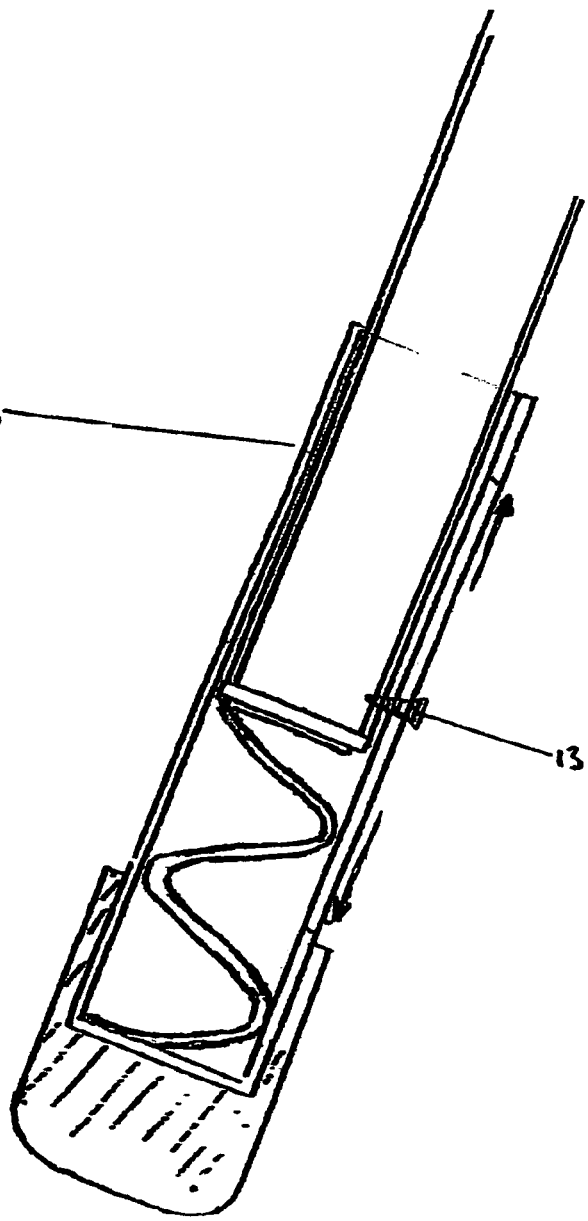
FIG. 6 illustrates the stabilizer leg with spring loaded foot socket.
Figure 7:
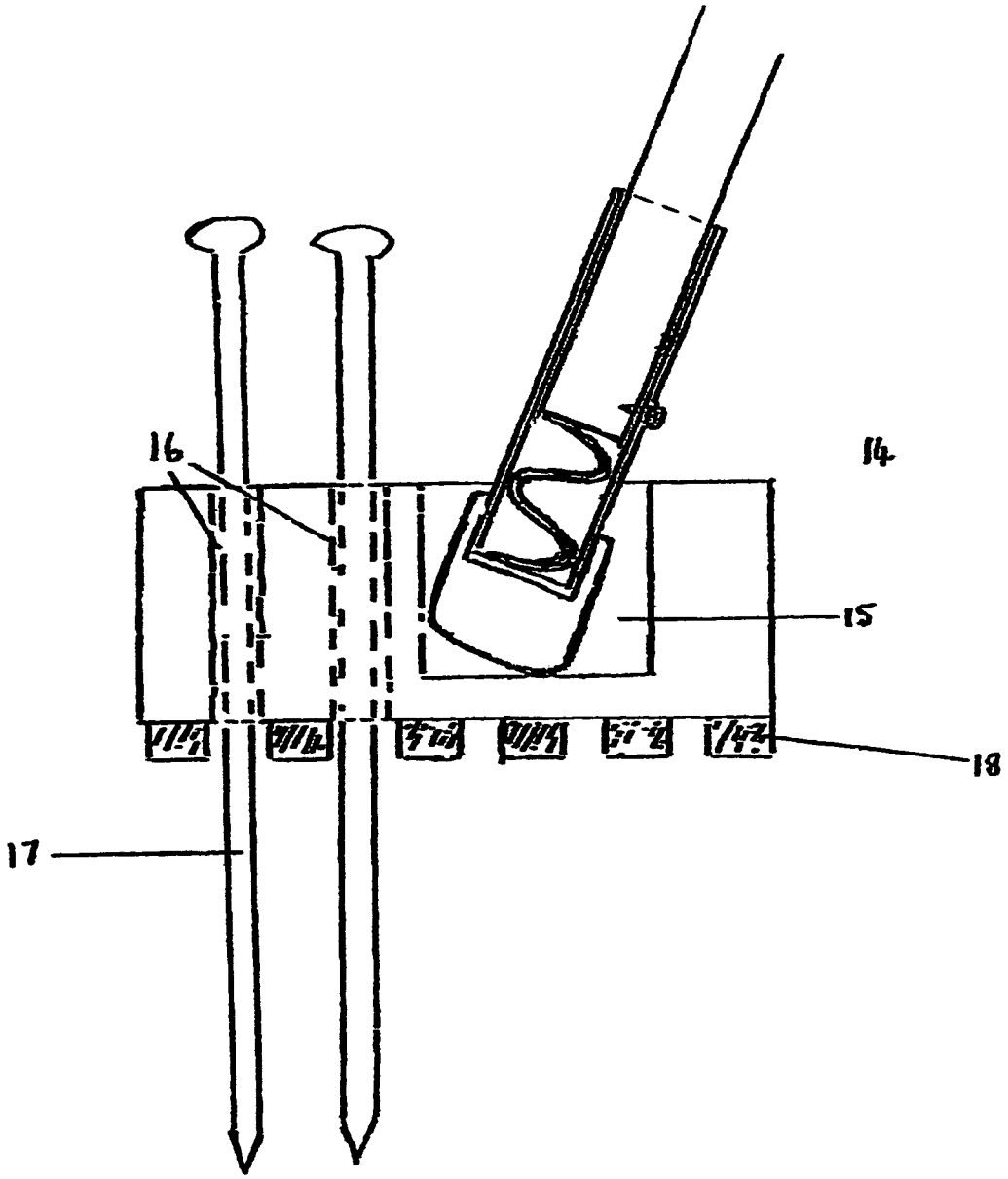
FIG. 7 illustrates the stabilizer leg with spikes.
Figure 8:
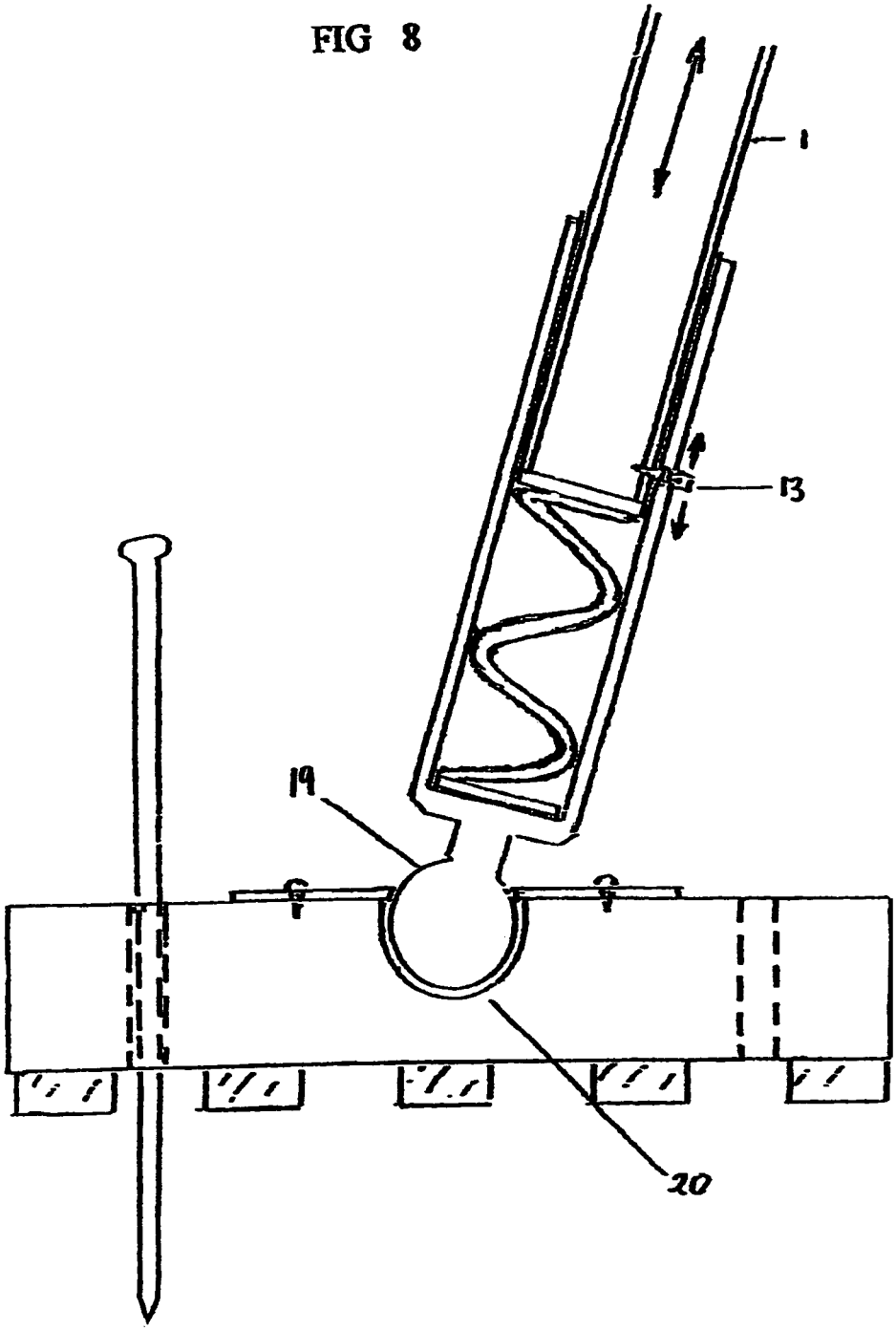
FIG. 8 illustrates the stabilizer leg with ball joint foot socket.
Figure 10:
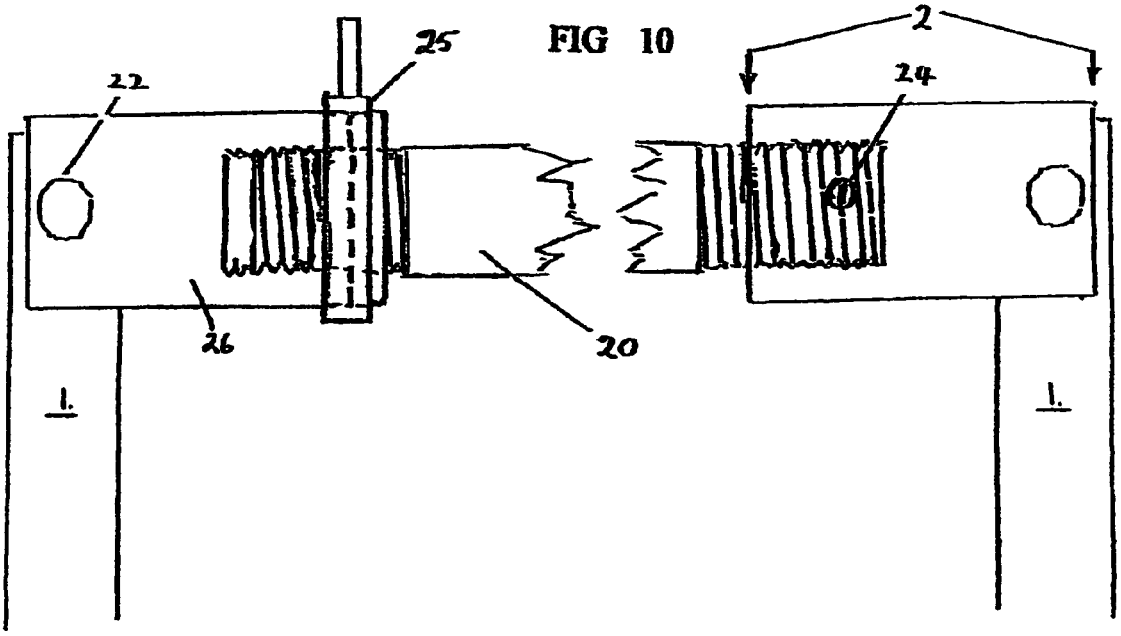
FIG. 10 illustrates the support bar, end bearing and locking device.

Construction:

The stabilizing legs (S.Ls.) FIG. (1) 1 are connected to the ladder by universal joints 2 on either side attached to a connecting support bar 20, that goes through the centre hollow space in a rung. They are made of strong light metal, fiberglass, plastic, or other rigid material capable of standing the stresses involved. On the lower ends they have a spring loaded foot socket 3 as well as, if necessary, a foot plate 4. The SLs can be folded along the length of the ladder, FIG. (2) and held in place with retaining clips for easy handling and storage. The SLs can have rigid hinged ties fitted to reduce the possibility of outward slippage on low friction surfaces FIG. (3) 5 that can be folded away when not in use Alternately a cord attached to the ladder and each SL to hold the three units in a triangular configuration may be satisfactory.

The foot sockets 3 are constructed of metal or other rigid material of the same profile as the SLs but slightly larger so that the SLs will slide easily within the unit FIGS. (5) and (6) and the foot socket thereby forms a loosely fitting casing around the lower end of the SL. The lower end of foot socket is sealed 8 and encased by a rubber, or soft non skid material surround. 9. The lower end of the SL is sealed 10 and between this and the sealed end of the foot socket 8 is a coiled compression spring. 11. A longitudinal guide slot 12 is cut in the side of the foot socket outer casing and a guide pin 13 fitted through this slot into the enclosed SL.

This mechanism now allows the SL to move up and down within the limits of the guide slot to a lower position where the spring is completely compressed to an upper position where the SL is up to several cms above the spring. The function of this unit 3 is to minimize overloading and movement due to the ladder flexing and producing either increased or decreased pressure along the SLs.

A foot plate FIG. (7) 14 may be necessary as a separate adjunct on soft or slippery surfaces (such as grass). It is considerably larger than the foot socket, is recessed deeply 15 to take the foot socket, and has one or more holes 16 through it to take securing spikes 17. The bottoms are ridged rubber or other non skid material. 18.

Alternately a fixed foot plate could be used with other means of attachment FIG. (8) such as a ball joint ending to the foot socket 19 inset and secured into a spherical recessed foot plate 20

The upper end of the each S.L. FIGS. (9) and (10) is connected to the support bar 20 by a universal joint. 2 The universal joints fit closely to the ladder 21 with sufficient clearance to allow completely free movement of the S.L.s. but minimal sideways movement of the support bar within the rung.

Position of Support Bar—

For Single steps or a folding step ladder,

The support bar may be inserted through the centre of any rung. If the rungs are irregular, then through the cavity in the rung, or if the rungs are solid, a male threaded attachment would need to be affixed on either side of the ladder. The SLs. with foot socket attached, can be made or cut to any length, but preferably about 2 to 5 cms shorter than the distance from the top universal to the bottom of the ladder.

For best stability, if possible, the bar should be inserted on the top rung of single steps or a stepladder. FIG. (1)

Extension Ladder:

As a permanent fixture the bar should be fitted preferably to the top rung of the lower section, and the S.L.s. should be made or cut to approximately 2 to 5 cms shorter than the distance from the top universal to the bottom of the ladder. For storage and handling, and when not in use, the S.L.s. should be folded close to, and in line with the outer side beam of the ladder, and held in place at the lower end by a Velcro fastener or a holding clip. FIG. (2)

An extension ladder if required can be fitted with a second set of stabilizing legs closer to the top of the extension section.

The second support bar would be fitted to a selected rung in the upper portion, and a longer set of S.L.s made or cut so that their length is approximately the corresponding distance to the base of the ladder when extended. These longer SLs, being considerably longer than the ladder when not extended, can be attached to or detached from the support bar either before or after the ladder has been extended, by inserting or removing the SL pivoting bolts. FIG. (9). Alternately telescopic extendable SLs can be fitted to a support bar in an upper rung of the extension, which, when collapsed are no longer than the un-extended ladder, to allow for easier storage and handling.

Universal Joints

The Universal Joints as shown in the diagrams FIGS. (9 & 10) are made up of a universal end bearing 26 slotted at one end to the width of the SL, 23 and having a hollow (female) socket at the other end threaded to the size of the threaded end of the support bar 24 Each slotted end is drilled to accommodate the SL pivoting bolt 22 which secures the similarly drilled stabilizing leg. 1. The slot is sufficiently deep so that the SL can freely rotate through 180 degrees about the SP pivoting bolt. Both universal joints are similar.

The diameter of the support bar 20 should be such that it loosely fits the hollow centre of the ladder rung, and is free to rotate within the rung. The bar should be of sufficient length that when fitted to the ladder the thread protrudes sufficiently on both sides for the end bearing to be screwed on securely.

One end bearing has a locking screw 24 which, when the bearing has been securely screwed onto the support bar, locks it tightly onto the bar.

When assembling, the other end bearing is screwed up firmly against the ladder and loosened by rotating it anti-clockwise by ¾ of a turn.

The movement of the SLs foreward and backwards is now facilitated by the unpinned end bearing rotating on the support bar while the lateral movement of the SLs takes place about the SL pivoting bolts.

If special circumstances require, the second end bearing can also be secured with a locking device, temporally locking the end bearing onto the support bar 25 thereby preventing it's rotation relative to the opposite end bearing. Should the support bar be replaced by two universal joints, one fitted to either side of the ladder, a locking device would be used for both sides.

This invention is not confined to the use of only two stabilizing legs as described, nor to the use of only an extra two SLs on the upper section of an extension ladder. A second pair of SLs can be attached to any support bar. Similarly at any other point along the ladder, additional SLs can be positioned, forming an array of SLs, all capable of individual positioning FIGS. (11) and (12)

For an alternate method for single leg and multiple leg attachments, the support bar can be internally threaded (28) at both ends, and Support Sockets—"SS". (29) used to support the Stabilizing Legs. FIG. (13)

A Support Socket is externally threaded (30) at one end and internally threaded (31) at the other, such that one end threads into the Support bar and a second socket (32) may thread into the other end of the first. Each supporting socket is drilled to create a pivot for the SLs (33).

A similar design in reverse can be used and bolted, or otherwise attached to the ladder (34) as in FIG. (14).

FIGS. (15) (16) & (17)

Show a wholistic embodiment of the invention and its preferred method of assembly but this does not exclude other variations in design, having similar functions.

A one piece stabilizing leg (1.1) is shown and is the preferred embodiment for smaller ladders up to approximately 3-4 meters, or for the lower section of extension ladders.

An extendable stabilizing leg (1.2), a variation of the telescopic leg, is the preferred embodiment when SLs are fitted to the upper portion of an extension ladder, or when SLs are required to be longer than the distance from the end bearing (26) or Support Socket (29) to the base of the ladder, when the ladder is in its retracted position, so that the S Ls when folded against the ladder, do not protrude past the ladder base.

FIG. (15) shows the hollow centre of a rung (35) of a ladder to which the invention is attached with the support bar (20) passing through it's centre, being slightly longer than the rung, and being internally threaded (28) at both ends. Into these ends are screwed through a washer (45) which is wider in diameter than the support bar (20) a support socket (29) externally threaded (30) at one end to fit the support bar (20) and internally threaded at the other end (31) to accept a second support socket (32). The second support socket is again internally threaded (31) at the other end to accept a further socket and could be similarly added to form an array of SLs as required.

Attached to each support socket with a pivoting bolt (22) through the pivot hole (33) is a stabilizing leg SL (1).

The SLs can be of any profile, but the preference to a square profile will be described.

The upper end of each SL, having a similar profile to the Support Sockets, have rigidly attached on either side, a support flange (46) through which a quick action pivoting bolt (22) attaches it through the pivot hole (33) to the Support Socket. To facilitate the lateral rotation of the SL on the Support Socket the top of the SL is trimmed at an angle of approximately 25 degrees (47)

The stabilizing legs (SLs) should preferably be in one piece (1.1) and as long as the height of the ladder will allow with an upper limit of approximately 4 meters, but slightly less than the distance from the selected mug to the base of the ladder so that when not in use the SLs can be folded back and clipped against the side beams of the ladder without protruding past its base.

Guide pin (13) and the Guide Slot (12). Below its sealed base (10) and above the sealed base of the foot socket (8) is a compression spring (11) and surrounding the base of the foot socket (3) is a non skid soft surround (9).

The foot socket is an important part of the invention such that it allows compression of the spring, thus allowing sagging or flexing of the ladder without producing excessive load on the SL. It allows also free movement upwards of approximately 3 cms. of the SL above the spring. This maintains the foot socket in contact with the ground due to its weight and to gravity, thereby maintaining the SL in its position, which otherwise, because it is free to rotate, may change it's placement on the ground causing instability of the ladder.

A foot socket positioning clip (37) allows the operator when positioning the stabilizing leg to lift the socket (3) with the operators foot so that the SLs end (10) is lightly in contact with the spring (11). (the spring contact position).

FIG. (16) Is an end view of FIG. (15) showing the Second Socket (32) internally threaded (31) with support flanges (46) attached to a stabilizing leg (1.1) the top of which is cut at an angle of approx. 25 degrees (47).

The support flanges (46) are attached to the second socket (32) by pivoting bolt (22) through pivoting Hole (33)

FIG. (17) Is a further embodiment used when a variable length of SLs is required (1.2), most particularly when a pair of SLs is fitted to a top section of an extension ladder. It is demonstrated with square section structured SLs in two sections, the upper part being attached to a support socket (29) as previously described and the lower section fitted to a foot socket (3) as previously described.

The upper and lower sections overlap one another for any distance required (38) and are positioned and held tightly in place when required by two compression locking clamps (39) The bottom clamp is rigidly attached to the bottom of the upper SL Section, while the top clamp is rigidly attached to the top of the bottom SL Section (42)

The opposing SL Section can slide freely past one other when the Screws (41) are loosened, or are held tightly together when the screws (41) are tightened against the pressure bars (40).

The minimum overlap of the upper and lower SL Sections should be approximately 15 cms. The combined length when fully extended should depends on the rung selected in the upper or lower section of an extension ladder in which a support bar is fitted, and should be in excess of the distance from the support bar to the base of the ladder.

This arrangement allows the extendable legs, when collapsed, to be folded against and clipped to the side beams of the ladder when not in use and to not protrude past the ends of the ladder for easy handling and erection.

Figure 9:
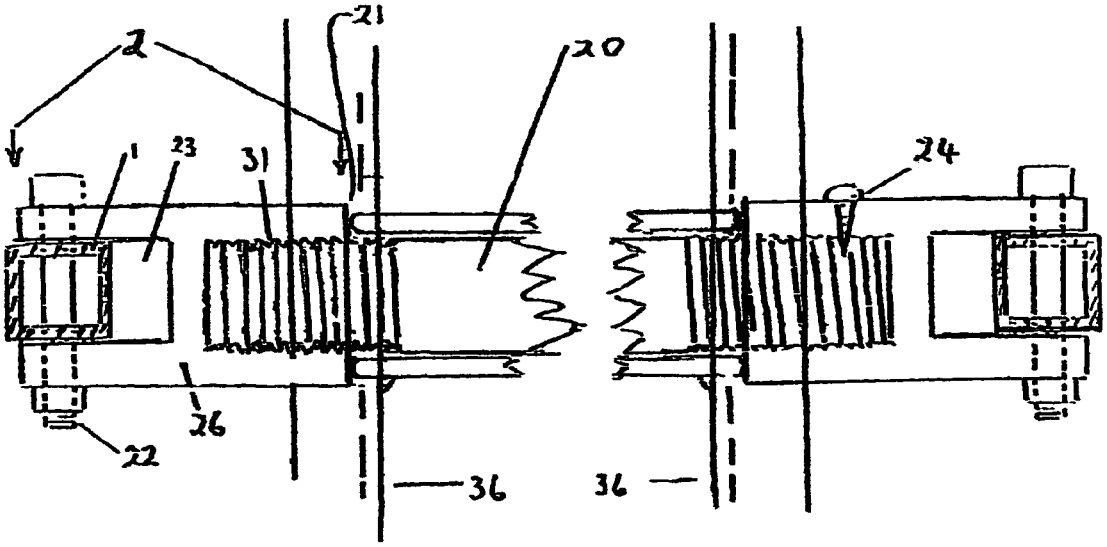
FIG. 9 illustrates the support bar and end bearing.
Figure 9A:
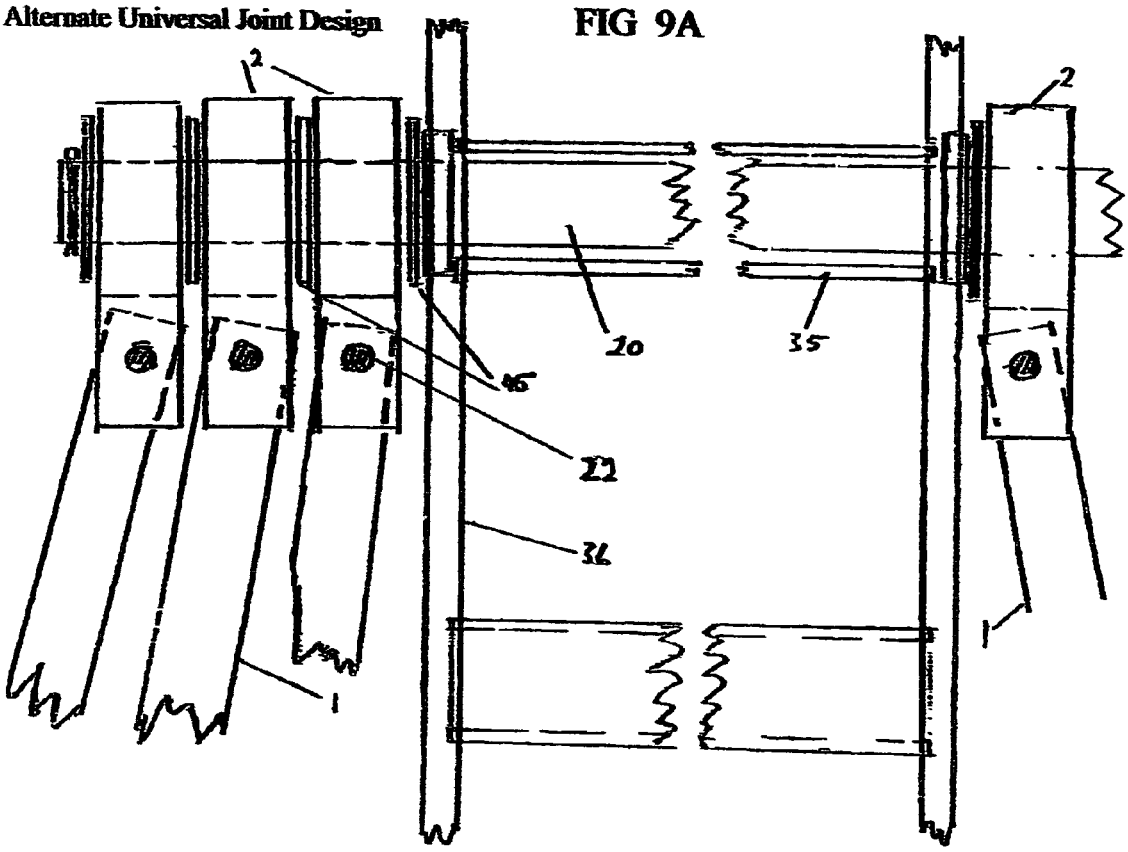
FIG. 9A illustrates an alternate universal joint and support bar.
Figure 9A:
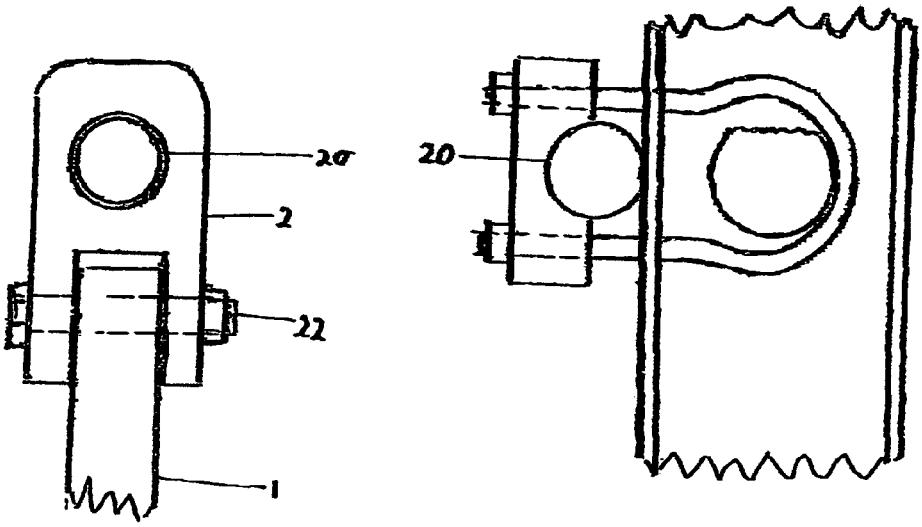
Figure 11:
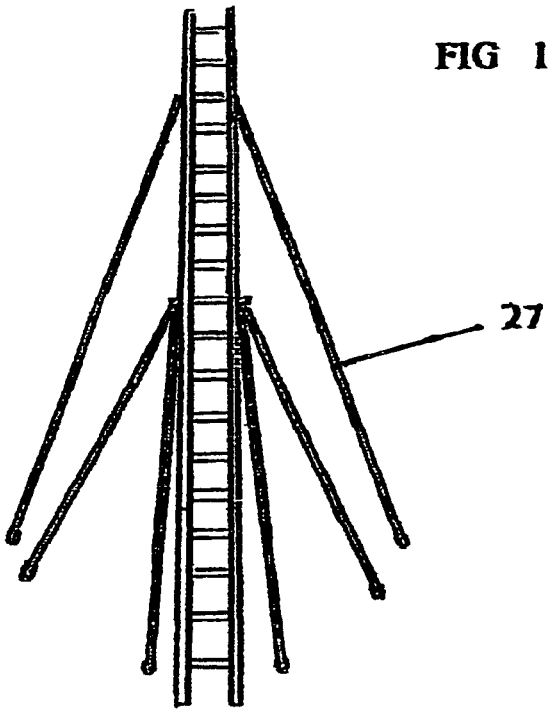
FIGS. 11 and 12 illustrate multiple arrays of the stabilizer legs.

An alternate type of universal joint attaching the Stabilizing legs to the Support Bar is depicted in FIG. 9A which serves the same purpose as the universal joints previously described but is made of nylon or other suitable material, pivoted on the support bar as before but not requiring threading. FIG. 9A also depicts an alternate method of attaching the support bar to a ladder if the bar can not be threaded through a rung of the ladder.

Mode of Use and Function of Components.

Figure 12:
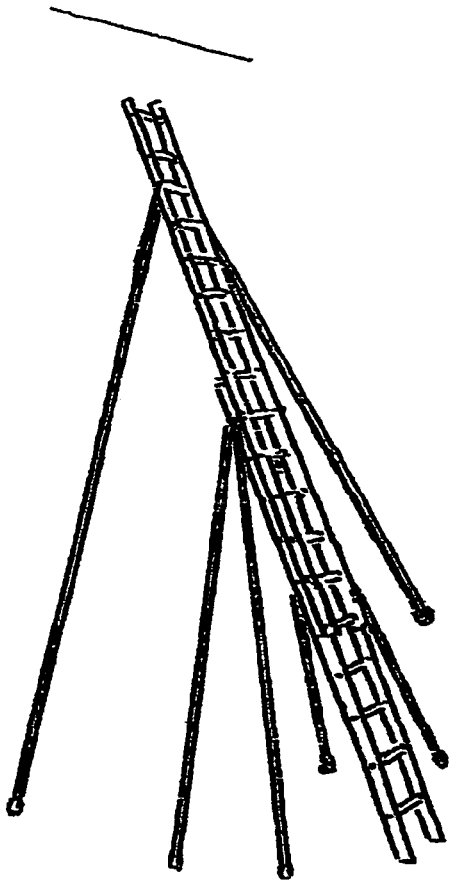

FIG. 12 shows an array of six stabilizing legs which when not in use would all fold up against and be clipped to the side beams of the extension ladder. A variable length SL would be used for the upper Section of the ladder, so that it would not protrude past the base of the ladder when transporting.

The ladder is placed in position against a wall and extended to the height required. Left side or Right side SLs can be positioned separately or all together.

For Left side first: The operator should unclip the outer smaller SL and move it laterally and forward towards the wall to be approximately vertically below it's support bar in the ladder. He should then with his foot lift the foot socket (3) by the foot socket positioning clip (37) so that the SL is lightly pressing on the compression spring (the spring contact position) and place the foot socket lightly on the ground. This positioning creates lateral stability for the ladder.

Now unclip the second smaller SL moving it laterally and forward and again with the operators foot place the foot socket in the spring contact position on the ground pointing laterally, but back towards the base of the ladder. This creates lateral stability but also a reduction in slip out of the ladder base, and allows for a flatter slope of the ladder to the wall.

Unclip the longer SL moving it laterally and forward, select the position for placement of the foot socket on the ground, loosen the 2 hand clamping screws (41) on the extendable SL, and, after increasing its length to the desired amount, tighten the clamping screws (41). The operator, with his foot, now lifts the foot socket to the spring contact position and places it on the ground. This long SL now because of it's higher attachment gives much greater stability to the ladder.

The SLs on the opposing (R) side are now similarly positioned in approximately mirrored positions to those on the other side, thus now forming a multi triangular supporting array to the ladder.

DRAWING LABELS

Figure 13:
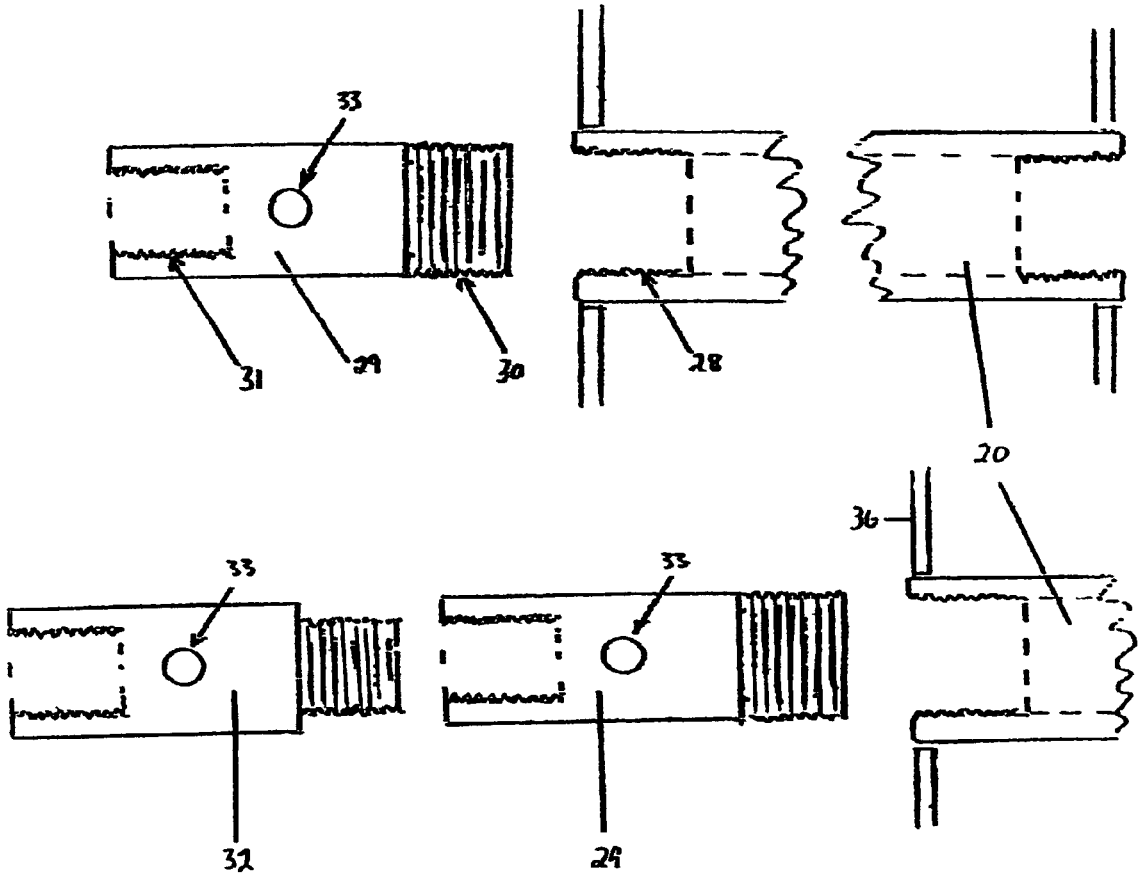
FIGS. 13 and 14 illustrate support sockets of the stabilizer legs.
Figure 14:
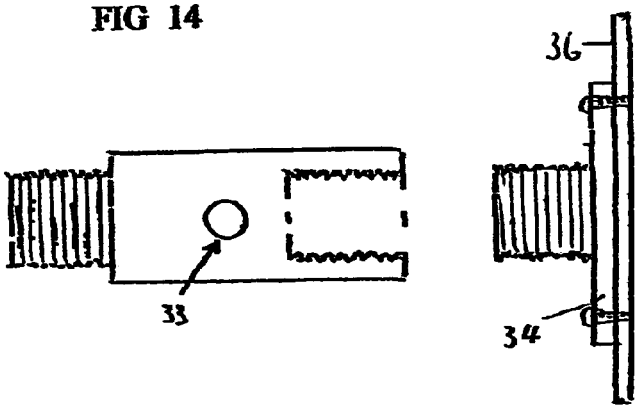
Figures 15, 16, 17:
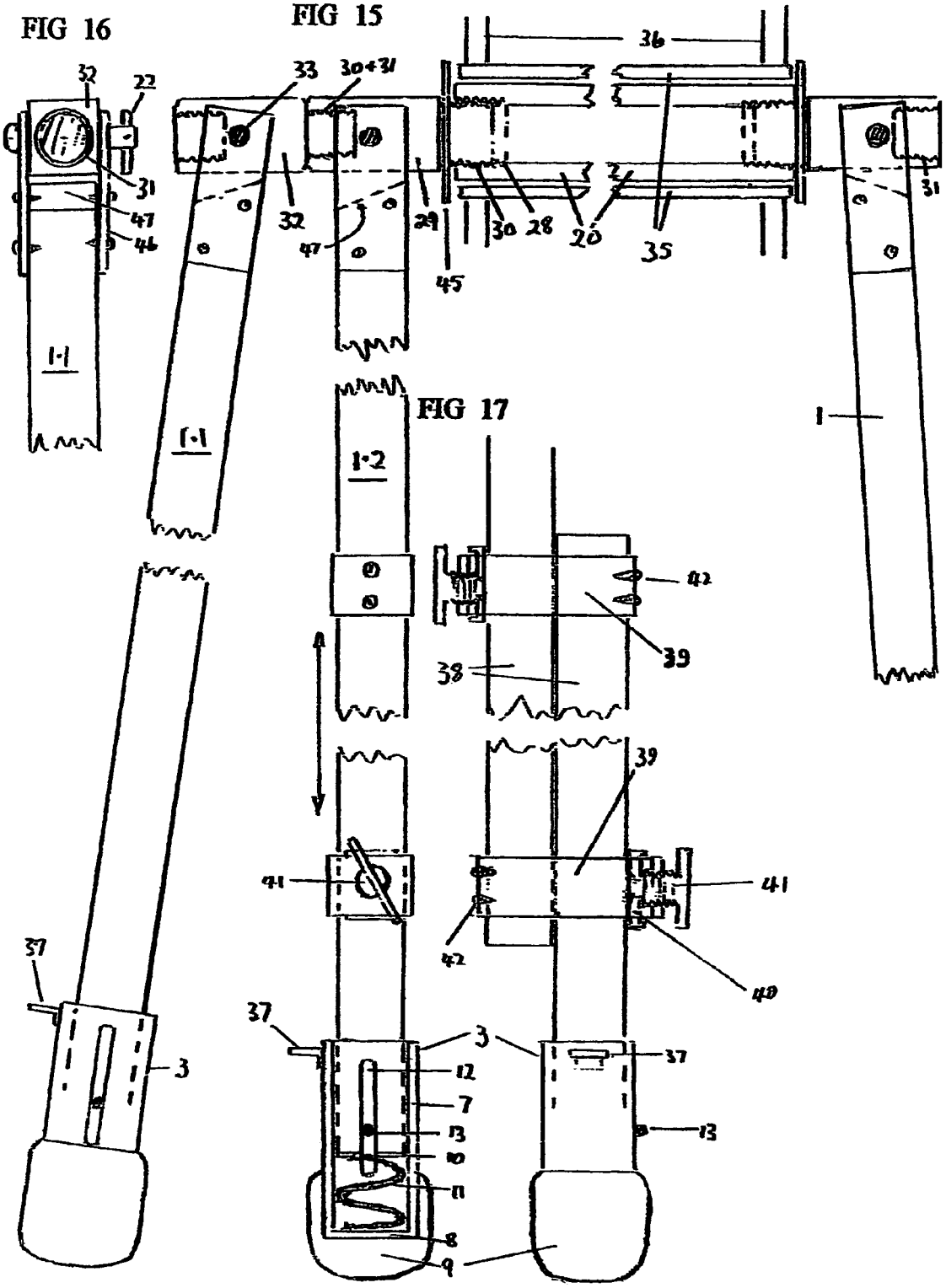
FIG. 15 illustrates the stabilizer legs attached to a hollow rung.
FIG. 16 illustrates an end view of the support socket.
FIG. 17 illustrates a variable length stabilizer leg.

1. Stabilizing legs (FIG. 1)
2. Universal Joints
3. Spring loaded Foot Socket
4. Foot Plate
5. Rigid Hinged Ties
6. Ties Folded Away.
7. Foot Socket Outer Casing
8. Foot Socket Sealed Base
9. Foot Socket Rubber Surround
10. Lower End of SL Sealed
11. Compression Spring
12. Guide Slot
13. Guided Pin
14. Foot Plate]
15. Deeply Recessed Foot plate
16. Spike Holes
17. Spikes
18. Non Skid Material
19. Ball Joint Ending Foot Socket FIGS. (9) & (10) Universal Joint
20. Support Bar
21. Close Fitting to Ladder
22. SL Pivoting Bolts
23. Universal End Bearing Slotted
24. Locking Screw
25. Locking Device
26. End Bearing
27. Multiple array of SLs. FIGS. (11) & (12).
28. S B Internally threaded. (FIGS. 13 & 14)
29. Support Socket
30. S.S. externally threaded
31. S.S. externally threaded
32. Second Socket
33. Pivot hole for S.L.s
34. Bolted ladder attachment
35. Hollow rung of ladder (FIGS. 15, 16 & 17)
36. Side beam of ladder
37. Foot socket positioning clip

38. Alternate length adjuster for Stabil. legs
39. Compression locking clamps
40. Pressure bar
41. Hand clamping screw
42. Securing screws
43. Front view if length adjuster
44. Side view of length adjuster
45. Washer
46. Support flanges
47. SL top angel 45 degrees The claims defining the invention are as follows:

1. A Ladder Stabilizing Attachments devise for extension ladders, step ladders, and other ladders and designed to improve lateral stability, reduce slide out tendency and unwanted movement to the ladder base comprising;

a pair or an array of pairs of stabilizing legs, said stabilizing legs being of one piece design or two piece extendable legs, and each at an upper end being fitted to a multi-universal joint device which allows the stabilizing leg to freely rotate in a pendulum motion in a first plain at right angle to the ladder about a pivoting bolt passing laterally through a socket of the multi-universal joint device, which allows the stabilizing leg to rotate in a pendulum motion at right angle to the first plain and in a plain of the ladder, said socket being attached to an end of a support bar which passes through a hollow rung of the ladder, and another end of the support bar having one or more similar sockets each forming a universal joint attaching a further stabilizing leg, and each stabilizing leg at its lower end is fitted to a foot socket device into which the stabilizing leg rests on a compression spring in a base of the foot socket and in which the stabilizer leg can move freely in a longitudinal movement up and down, the longitudinal movement being limited by a guide pin secured to the stabilizing leg within the confines of a guide slot cut longitudinally in a casing of the foot socket, whereby when in use downward pressure of the stabilizing leg by the weight of the ladder and operator compresses the compression spring while upward lift of the stabilizing leg through rocking of the ladder can raise its lower end 2-4 cm above the compression spring allowing the foot socket to remain in contact with the ground, wherein each stabilizing leg attached by the pivoting bolt that forms part of the universal joint device allows lateral movement, said support comprises a square metal support socket allowing rotational movement and being externally threaded at one end and internally threaded at the other, such that a stabilizer leg of the stabilizing legs adjacent to the ladder said threaded one end is threaded into a hollow of the support bar which is threaded at both ends, and passing through an arbitrarily selected rung of the ladder and the other threaded end has threaded into it a further similar square metal support socket to which is attached a further of the stabilizing legs, wherein each square metal support socket is attached to one of the stabilizing leg allowing the array of pairs of stabilizing legs to be attached to both ends of a single support bar.

2. The Ladder Stabilizing Attachments device as in claim 1, wherein the foot socket is constructed of metal or other rigid material as the stabilizing legs but slightly larger, so that the leg, when inserted into the foot socket will slide easily in the socket.

* * * * *